US011253759B2

(12) United States Patent
Hasegawa et al.

(10) Patent No.: US 11,253,759 B2
(45) Date of Patent: Feb. 22, 2022

(54) GOLF CLUB

(71) Applicant: SUMITOMO RUBBER INDUSTRIES, LTD., Hyogo (JP)

(72) Inventors: Hiroshi Hasegawa, Kobe (JP); Hiroyuki Takeuchi, Kobe (JP); Yuuichiro Yoneyama, Kobe (JP)

(73) Assignee: SUMITOMO RUBBER INDUSTRIES, LTD., Hyogo (JP)

( * ) Notice: Subject to any disclaimer, the term of this patent is extended or adjusted under 35 U.S.C. 154(b) by 0 days.

(21) Appl. No.: 16/819,339

(22) Filed: Mar. 16, 2020

(65) Prior Publication Data

US 2020/0338405 A1 Oct. 29, 2020

(30) Foreign Application Priority Data

Apr. 26, 2019 (JP) ..... JP2019-085650

(51) Int. Cl.
*A63B 53/14* (2015.01)
*A63B 53/08* (2015.01)

(52) U.S. Cl.
CPC ..... *A63B 53/08* (2013.01); *A63B 53/14* (2013.01)

(58) Field of Classification Search
CPC ..... A63B 53/08; A63B 53/14; A63B 60/54; A63B 60/50; A63B 2209/02; A63B 2209/00; A63B 60/24
See application file for complete search history.

(56) References Cited

U.S. PATENT DOCUMENTS 3,625,513 A * 12/1971 Ballmer ..... A63B 60/16 473/310
4,128,242 A * 12/1978 Elkins, Jr. ..... A63B 60/42 473/291
4,165,874 A * 8/1979 Lezatte ..... A63B 60/00 473/291
4,674,746 A * 6/1987 Benoit ..... A63B 60/24 30/308.1
5,686,158 A * 11/1997 Gibbon ..... A63B 53/14 428/36.92
5,716,289 A * 2/1998 Okoneski ..... A63B 60/24 473/297

(Continued)

FOREIGN PATENT DOCUMENTS

JP 2006025935 A * 2/2006
JP 2011-229828 A 11/2011

(Continued)

*Primary Examiner* — Stephen L Blau
(74) *Attorney, Agent, or Firm* — Greenblum & Bernstein, P.L.C.

(57) ABSTRACT

A golf club comprises: a golf club shaft extending from its first end to second end in its axis direction; a golf club head attached to the second end of the golf club shaft; a grip attach to the first end of the golf club shaft and having a grip end; and a weight member attached to the golf club shaft. The specific gravity of the weight member is 2.5 or more. The length of the weight member is 20 mm or less. The weight member is disposed in a grip-end portion of the golf club shaft so that a mass distribution in the axis direction of the grip-end portion has a local maximum occurring at a position within the grip-end portion, wherein the grip-end portion is defined as extending from the grip end toward the second end by 40 mm in the axis direction.

14 Claims, 8 Drawing Sheets

(56) References Cited

U.S. PATENT DOCUMENTS 6,007,431 A * 12/1999 Bloom, Jr. ..... A63B 53/00 473/292
6,764,414 B2 * 7/2004 Kumamoto ..... A63B 60/54 473/297
7,704,161 B2 * 4/2010 Lindner ..... A63B 60/00 473/297
8,182,360 B2 * 5/2012 Cameron ..... A63B 53/007 473/297
8,216,085 B2 * 7/2012 Fujimoto ..... A63B 53/00 473/292
8,641,551 B2 * 2/2014 Johnson ..... A63B 53/14 473/297
8,715,101 B2 * 5/2014 Naruo ..... A63B 53/10 473/292
9,522,313 B2 * 12/2016 Betts ..... G06K 9/00342
9,539,481 B2 * 1/2017 Solhaug ..... A63B 60/24
2001/0005696 A1 * 6/2001 Hedrick ..... A63B 60/00 473/318
2004/0147339 A1 * 7/2004 Lindner ..... A63B 60/24 473/316
2006/0142093 A1 * 6/2006 Moriyama ..... A63B 53/00 473/292
2011/0159982 A1 * 6/2011 Takeuchi ..... A63B 60/22 473/299
2011/0269565 A1 11/2011 Karube
2012/0165109 A1 * 6/2012 Takeuchi ..... A63B 60/42 473/297
2015/0018114 A1 * 1/2015 Stokke ..... H04L 67/141 473/287
2015/0045136 A1 * 2/2015 Boccieri ..... A63B 60/16 473/297
2015/0251062 A1 * 9/2015 Kuo ..... A63B 60/24 473/297
2015/0251064 A1 * 9/2015 Chapin ..... A63B 60/24 473/297
2016/0250528 A1 * 9/2016 Barksdale ..... A63B 60/06 473/287

FOREIGN PATENT DOCUMENTS

JP 2014207972 A * 11/2014
WO WO 01/47611 * 7/2001
WO WO-2010062563 A3 * 7/2010 ..... A63B 60/02

* cited by examiner

GOLF CLUB

TECHNICAL FIELD

The present invention relates to a golf club, more particularly to a structure of a grip portion of a golf club.

BACKGROUND ART

In recent years, a golf club in which a weight member is attached to a grip portion of the golf club shaft have been proposed. Since the center of gravity of such a golf club is shifted toward the grip side, namely, toward the golfer's hands, it is expected that the golf club becomes easy to swing and thereby the head speed is improved.

As a related art, the following Patent Document 1 is known. Patent Document 1: Japanese Patent Application Publication No. 2011-229828A (Patent No. 4693133)

SUMMARY OF THE INVENTION

Problems to be Solved by the Invention

The above-mentioned golf club, however, often involves problems such that the mass of the golf club is increased by the added weight member and the swing balance of the golf club is felt heavy, and as a result, the expected improvement in the head speed cannot be sufficiently obtained.

In view of the above problems, the present invention was made, and it is a primarily objective of the present invention to provide a golf club in which the center of gravity of the golf club is shifted toward the grip, while controlling an excessive increase in the mass of the golf club and suppressing the heavy feeling of the swing balance of the golf club.

According to the present invention, a golf club comprises:

a golf club shaft extending from its first end to its second end in the axis direction thereof;

a grip attach to the first end of the golf club shaft and having a grip end which defines an end of the golf club on the first end side;

a golf club head attached to the second end of the golf club shaft; and a weight member attached to the golf club shaft, wherein a specific gravity of the weight member is 2.5 or more, a length of the weight member measured in the above-said axis direction is 20 mm or less, and the weight member is disposed in a grip-end portion of the golf club shaft so that a mass distribution in the above-said axis direction of the grip-end portion has a local maximum occurring at a position within the grip-end portion, wherein the grip-end portion is defined as extending from the above-said grip end toward the second end by a length of 40 mm in the above-said axis direction.

The above-said mass distribution may have only one local maximum.

The above-said mass distribution has a minimum occurring at a position within the grip-end portion, and a difference between a mass of a minute section of the golf club shaft in the above-said axis direction at the position where the above-said local maximum occurs and that at the position where the above-said minimum occurs may be not less than 0.5 g when the dimension of the minute section in the above-said axis direction is 1 mm.

The golf club shaft may be a pipe having an interior space therein, and the weight member may be disposed in the interior space in its first end side.

The weight member may be covered with an elastic cover made of a rubber-like elastic material so as not to directly contact with the golf club shaft.

The weight member may be arranged without protruding from the golf club shaft.

Therefore, in the golf club according to the present invention, the center of gravity of the golf club is shifted toward the grip by the weight member, while controlling the increase in the mass of the golf club to thereby suppressing the heavy feeling of the swing balance of the golf club. Thus, it is possible to provide a golf club in which the user or golfer can improve the speed of the golf club head.

DESCRIPTION OF THE PREFERRED EMBODIMENTS

Figure 1:
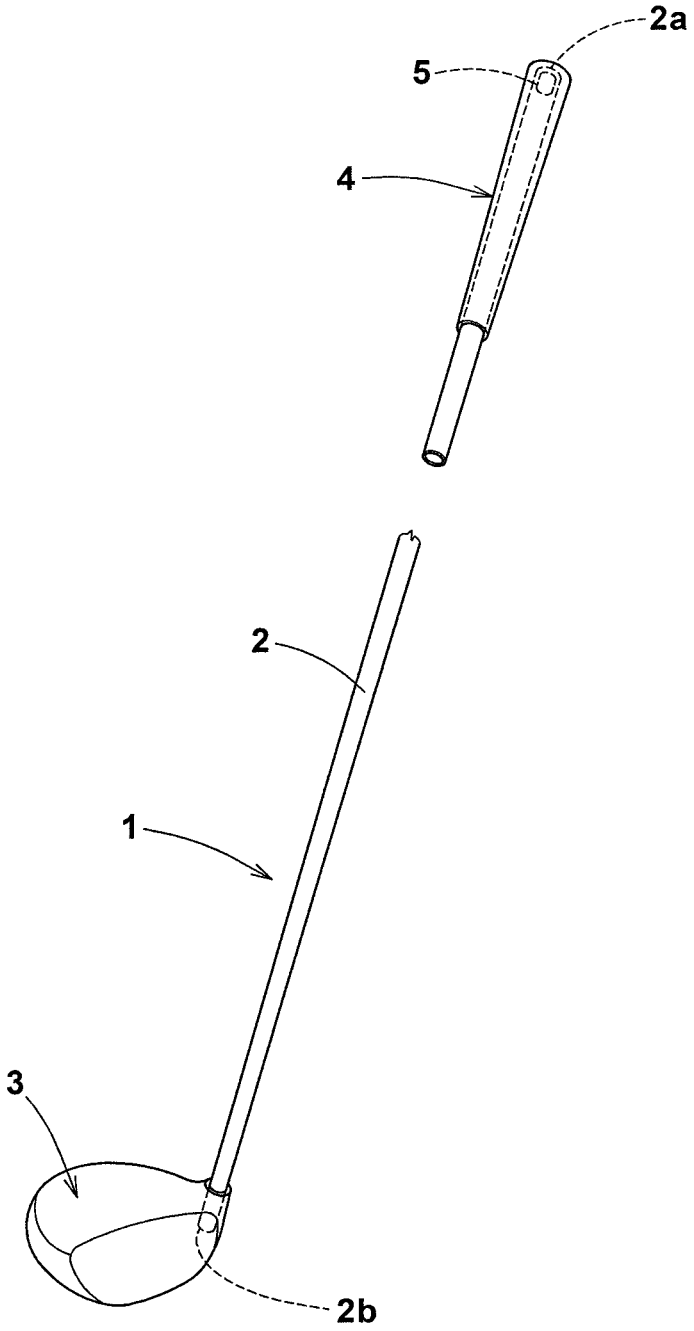
FIG. 1 is a perspective view of a golf club as an embodiment of the present invention.

Embodiments of the present invention will now be described in detail in conjunction with accompanying drawings. Throughout the embodiments, the same members, parts and portions are denoted by the same reference numerals, and redundant descriptions will be omitted hereinafter.

[General Structure]

According to the present invention, a golf club 1 comprises a golf club shaft 2, a golf club head 3, a grip 4, and a weight member 5.

FIG. 1 shows a golf club 1 as an embodiment of the present invention.

In the present embodiment, the golf club 1 is a wood type golf club. Here, a wood-type golf club includes not only a driver but also a fairway wood such as a spoon and a buffy.

[Golf Club Shaft]

Figure 2:
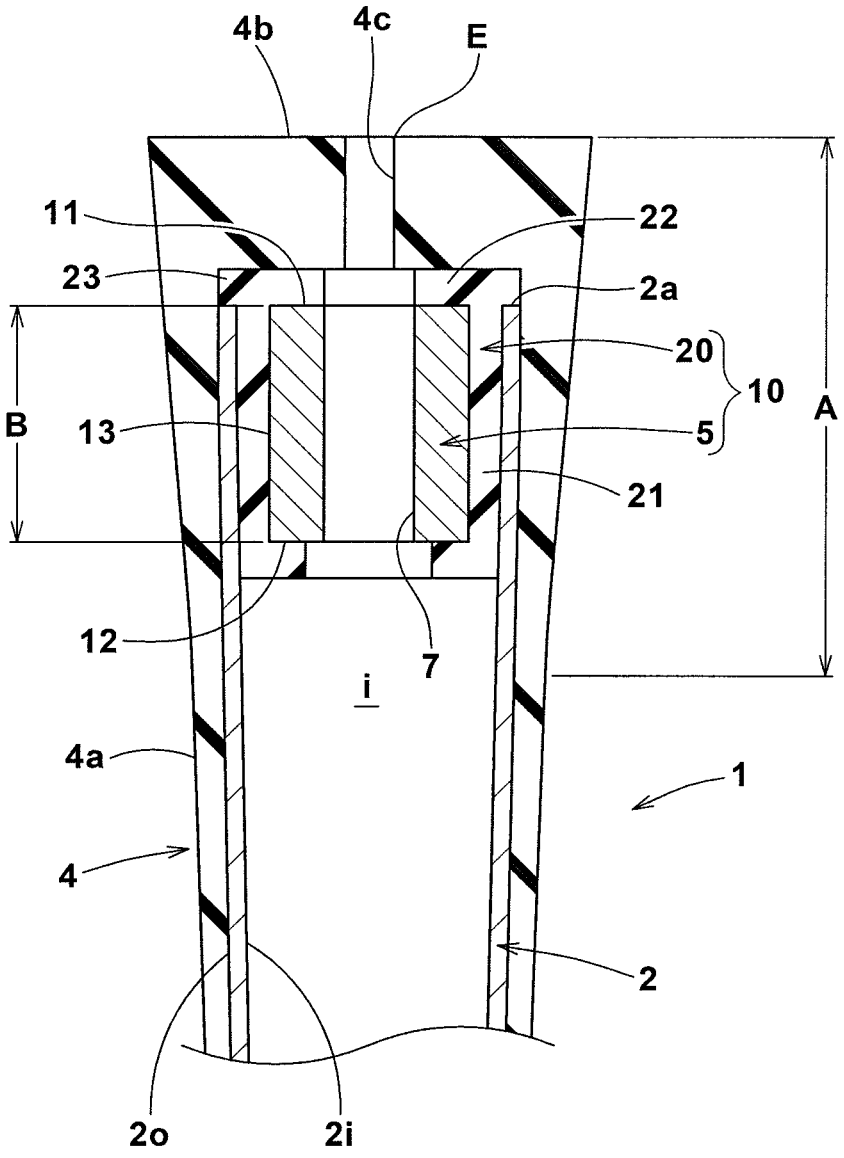
FIG. 2 is a cross-sectional partial view of the grip of the golf club.

FIG. 2 shows a cross-section of the grip 4 shown in FIG. 1, taken along the center of axle of the golf club shaft 2.

The golf club shaft 2 in this example is a pipe having an interior space (i) therein.

Preferably, the golf club shaft 2 has a cylindrical shape. That is, in the cross section of the golf club shaft 2 perpendicular to the axis direction of the golf club shaft, the outer peripheral surface 2*o* and the inner peripheral surface 2*i* are both circular.

The golf club shaft 2 may be made of various materials, for example, a fiber reinforced resin and a metal material. The golf club shaft 2 in this example is made of a carbon fiber reinforced resin.

The golf club shaft 2 has a first end 2*a* and a second end 2*b* in its axis direction. That is, the golf club shaft 2 extends from the first end 2*a* to the second end 2*b*. Preferably, the golf club shaft 2 is formed in a tapered shape in which both the outer diameter and the inner diameter are gradually decreased from the first end 2*a* toward the second end 2*b*.

[Golf Club Head]

The golf club head 3 has a club face for hitting a ball and is fixed to the second end 2*b* or tip end of the golf club shaft 2. In the present embodiment, the golf club head 3 is a wood-type hollow metallic head.

But, the golf club head 3 may be formed as an iron type head, a hybrid type head, or a putter type head.

[Grip]

The grip 4 is fixed to the first end 2*a* of the golf club shaft 2. The grip 4 in this example comprises a grip portion 4*a* to be gripped by a golfer, and an end portion 4*b* positioned at one end of the grip portion 4*a*.

The end portion 4*b* defines the grip end E which is endmost of the golf club 1 on the first end (2*a*) side.

The grip portion 4*a* has a substantially cylindrical shape. More specifically, the outer peripheral surface of the grip portion 4*a* is tapered from the grip end E toward the opposite end thereof. And the opposite end of the grip portion 4*a* has an opening.

For example, an adhesive agent, a double-sided tape or the like is applied to an end portion on the first end (2*a*) side of the golf club shaft 2 in advance. Then, by inserting the end portion into the bore of the grip 4 through the above-said opening, the grip 4 and the golf club shaft 2 are fixed to each other.

In order to discharge air existing in the grip 4 when the golf club shaft 2 is inserted into the grip 4, the above-said end portion 4*b* is provided with a through hole 4*c*.

The material of the grip 4 is not essentially, but rubber is preferred, for example. As to the rubber, for example, natural rubber, styrene butadiene rubber, EPDM, isoprene rubber and mixtures thereof are preferably used.

From the viewpoint of moldability of the grip 4, EPDM and styrene-butadiene rubber are preferred.

[Weight Member]

According to the present invention, in order to adjust a swing balance of the golf club 1, the weight member 5 is included in the golf club 1.

More specifically, in order to shift the center of gravity of the golf club 1 toward the grip 4, the weight member 5 is disposed in a grip-end portion (A) of the golf club 1. Here, the grip-end portion (A) is defined as extending from the grip end E toward the second end 2*b* by a length of 40 mm in the axis direction of the golf club shaft.

Thus, the weight member 5 is disposed on the opposite side of the golf club shaft 2 to the golf club head 3.

Such weight member 5 serves to provide the golf club 1 with a counterbalance effect.

The specific gravity of the weight member 5 is set to be 2.5 or more in order to provide a large mass on the grip (4) side of the golf club 1 with a small volume. when the specific gravity of the weight member 5 is less than 2.5, there is a problem such that the volume of the weight member 5 becomes large in order to obtain a sufficient counterbalance effect. As a result, it becomes difficult to attach the weight member 5 to the golf club 1.

If the weight member 5 is enlarged in the axis direction of the golf club shaft in order to obtain a necessary mass, the mass cannot be concentrated locally on the grip (4) side of the golf club 1.

Therefore, it is preferred that the specific gravity of the weight member 5 is 5.0 or more, more preferably 7.0 or more, still more preferably 8.0 or more in order to obtain a sufficient counterbalance effect with a small volume.

The upper limit of the specific gravity of the weight member is not specified here, since it depends on available materials.

The length B of the weight member 5 in the axis direction of the golf club shaft is preferably set to be 20 mm or less. By limiting the length B to be smaller, the mass of the weight member 5 can be concentratedly distributed to the grip (4) side of the golf club 1. However, if the length B is too small, a sufficient counterbalance effect may not be obtained, therefore, the length B is preferably set to be 3 mm or more.

As the weight member 5, various materials can be adopted as long as the above-mentioned specific gravity is satisfied.

In particular, a metal material is preferred.

In this embodiment, brass is used as the weight member 5, but the weight member 5 is not limited to this.

[Structure of Grip-End Portion]

The inventors have made intensive studies to shift the center of gravity of the golf club toward the grip (to be counterbalanced) while suppressing an excessive increase in the mass of the golf club and the heavy feeling of the swing balance of the golf club.

As a result, it was found that it is effective to downsize the weight member 5 by specifically limiting the specific gravity and the axial length B within the above-described ranges as well as to specifically control the mass distribution of the grip-end portion (A) on the grip side of the golf club 1.

Figure 3:
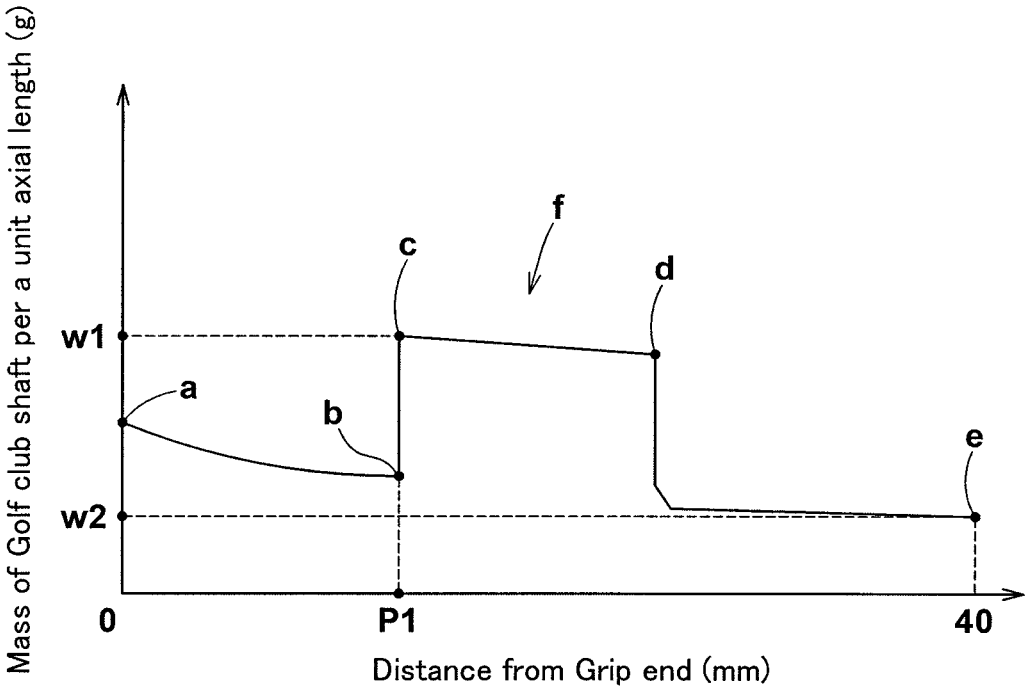
FIG. 3 is a graph showing a curve of the mass distribution of the grip-end portion of the golf club shaft of the golf club.

Specifically, the grip-end portion (A) is constructed (described hereinafter) so as to have a mass distribution in the axis direction of the golf club shaft such that a local maximum occurs at a position within the grip-end portion (A), namely, within a range 40 mm from the grip end E as shown in FIG. 3, for example. FIG. 3 shows a mass distribution curve f indicating the mass of the grip-end portion (A) per a unit length in the axis direction of the golf club shaft (vertical axis: g) as a function of a distance in the axis direction from the grip end E (horizontal axis: mm). And the mass distribution curve f has a local maximum value (at Point (c)) in the grip-end portion (A).

By configuring the grip-end portion (A) as above, a limited mass of the weight member 5 can be more concentratedly distributed to the grip (4) side of the golf club 1. Therefore, the counterbalancing of the golf club 1 can be achieved while suppressing an excessive increase in the mass of the golf club and the heavy feeling of the swing balance of the golf club.

FIG. 3 shows an example of the mass distribution curve f in the grip-end portion (A), wherein the horizontal axis represents a position in the axis direction of the golf club shaft indicated by the distance from the grip end E, and the vertical axis represents the mass of a minute section of the golf club shaft in the axis direction of the golf club shaft.

The minute section is defined as having a unit length in the axis direction of the golf club shaft.

In this example, the unit length is 1 mm.

Thus, the vertical axis shows the mass of the golf club shaft per 1 mm in the axis direction.

The mass of the minute section at any axial position is that of a portion between the above-said axial position and an axial position 1 mm toward the second end 2*b* therefrom.

For example, in the mass distribution curve f, the mass at the origin (axial distance is zero) is the mass of a minute section between 0 mm and 1 mm from the grip end E.

The mass of a minute section describes a mass distribution curve f as shown in FIG. 3.

The mass distribution curve f in this example starts from Point (a) at the grip end E and continues to Point (b) while gradually decreasing the mass.

In this range from (a) to (b), the mass is mainly that of the grip 4, and the gradual decrease in the mass of the minute section is due to the tapered shape of the grip 4.

In the mass distribution curve f, the mass of the minute section is rapidly increased from Point (b) to Point (c), and then gradually decreased from Point (c) to Point (d).

In the range from (b) to (d), the mass is mainly the total mass of the grip 4, the golf club shaft 2 and the weight member 5. In the range from (c) to (d), the gradual decrease in the mass of the minute section is caused by the tapered shapes of the golf club shaft 2 and the grip 4.

But, the grip-end portion (A) in particularly in the range from (c) to (d) can be configured so that such gradual decrease is mainly caused by the shape of the weight member 5 rather than the tapered shapes of the golf club shaft 2 and the grip 4.

In the mass distribution curve f, the mass of the minute section is sharply decreased from Point (d), and then gradually decreased toward Point (e) at the end of the grip-end portion (A).

In the range from (d) to (e), the mass is mainly that of the grip 4 and/or that of the golf club shaft 2, and the decrease in the mass of the minute section is due to their tapered shapes.

The mass distribution curve f as described above has Point (c) at which the mass of the minute section becomes local maximum. At the same time, the mass of the minute section at Point (c) is absolute maximum in the grip-end portion (A) in this example. Namely, the mass distribution curve f becomes a maximum value at Point (c) within the grip-end portion (A). Therefore, in the golf club 1 in the present embodiment, a large mass is arranged locally within the grip-end portion (A) at the position corresponding to Point (c) of the mass distribution curve f (or at the distance P1 from the grip end E).

As a result, the counterbalancing of the golf club 1 is effectively realized.

Incidentally, Point (a) is not local maximum because the mass is not changed from increment to decrement through this point. Point (b) is local minimum, and Point (e) is absolute minimum in the grip-end portion (A) (from 0 to 40 mm).

Preferably, the mass distribution curve f has only one local maximum value (thus, equal to the absolute maximum value) in the grip-end portion (A). As a result, the mass is concentrated at one place locally, and the above-described effect is more remarkably exhibited.

It is preferable that, when the dimension of the minute section in the axis direction is 1 mm, the difference between a maximum value w1 of the mass distribution curve f (at Point (c) in this example) and a minimum value w2 of the mass distribution curve f (at Point (e) in this example)

is 0.5 g or more, more preferably 0.6 g or more.

Thereby, a large mass is arranged in the grip-end portion (A) in a further concentrated manner.

In the mass distribution curve f in the grip-end portion (A), the distance P1 at which the maximum value lies is preferably 20 mm or less from the grip end E. Namely, the grip-end portion (A) is so configured, therefore, a large mass is arranged in a grip end side of the grip-end portion (A) in a further concentrated manner.

The mass of the weight member 5 is not particularly limited, and the mass can be adjusted variously according to a target golf club.

Usually, the mass of a golf club is designed within a certain range in consideration of ease of swing. If the mass of the weight member 5 is large, it is not preferable because other functions may be restricted in order to keep the mass of the golf club within such a certain range.

From such a viewpoint, it is preferred that the mass of the weight member 5 is about 0.5% to 8%, more preferably about 1% to 5% of the mass of the golf club, for example.

In the case of a wood type golf club as in this embodiment, it is preferred that the mass of the weight member 5 is set in a range from 2 to 15 g, for example.

[Weight Member]

Examples of the weight member 5 will be described below.

In the example shown in FIG. 2, the weight member 5 is disposed in the interior space (i) of the golf club shaft 2 in its first end (2*a*) side.

According to such arrangement, it is possible to provide a new advantage such that the weight member 5 can be incorporated in the shaft without the need to refurbish the grip 4 (that is, it is possible to use a general-purpose grip).

If the weight member is combined with the grip, the flexibility of the grip may be impaired, and the grip feeling and the formability of the grip may be deteriorated. However, in this example, such a problem can be solved. In addition, since the weight member 5 is arranged in the interior space (i) of the golf club shaft 2, the weight member 5 does not come into the golfer's sight, and the swing feeling is not disturbed thereby.

In this example, it is preferable that the weight member 5 is covered with a cover 20 made of a rubber-like elastic material so as not to directly contact with the golf club shaft 2. Such structure provides a new advantage of preventing generation of abnormal noise due to friction between the weight member 5 and the golf club shaft 2 when the golf club 1 hits a ball. Further, the problem of damage to the golf club shaft 2 due to friction with the weight member 5 can be solved.

Preferably, the weight member 5 is prepared in a state in which the weight member 5 is previously covered with the cover 20, that is, prepared as an assembly 10 of the weight member and the cover 20. Then, the assembly is disposed in the interior space (i) of the golf club shaft 2.

Figure 4:
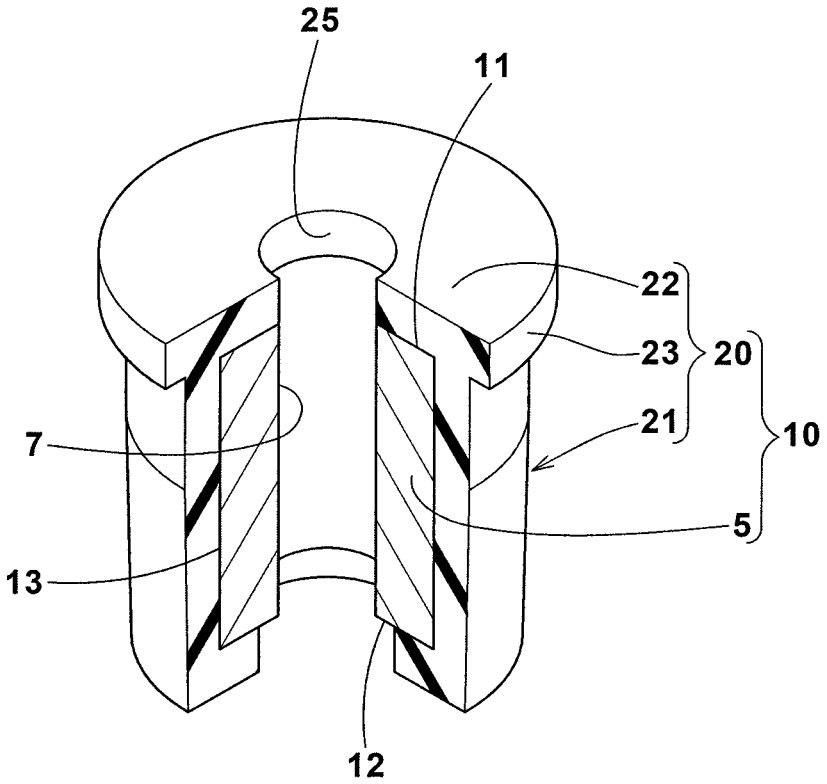
FIG. 4 is a perspective view of an example of a weight member assembly.

FIG. 4 shows an example of such assembly 10 of the weight member and the cover 20. As shown, the weight member assembly 10 is composed of the metallic weight member 5 and the cover 20 made of a rubber-like elastic material.

Preferably, the weight member assembly 10 is formed integrally, for example, by supplying an unvulcanized elastomer or a liquid resin around the weight member 5 and curing it in a mold.

As shown in FIGS. 2 and 4, the weight member 5 in this example is formed in a cylindrical shape having a central hole 7 extending in the axis direction of the golf club shaft. Thus, the weight member 5 has a first end surface 11, a second end face 12, and an outer peripheral face 13.

In the axis direction of the golf club shaft, the first end surface 11 of the weight member 5 is located on the first end (2*a*) side, and the second end face 12 is located on the second end (2*b*) side.

In this example, the first end surface 11 and the second end surface 12 are both formed as flat surfaces perpendicular to the axis direction of the golf club shaft, but these end surfaces are not limited to such configuration.

As shown in FIGS. 2 and 4, the outer peripheral surface 13 of the weight member 5 is a cylindrical surface extending along the axis direction of the golf club shaft.

The cover 20 is made of a material having rubber-like elasticity including vulcanized rubber and resinous materials. The cover 20 in this example is made of vulcanized rubber.

The cover 20 includes a side cover 21 as shown in FIG. 4. The side cover 21 covers the entire outer peripheral surface 13 of the weight member 5. That is, the side cover 21 has a cylindrical shape and covers the entire surface of the outer peripheral surface 13 of the weight member 5 in the circumferential direction and in the axis direction of the golf club shaft.

It is preferable that the outer diameter of the side cover 21 is substantially the same as the inner diameter of the golf club shaft 2 so as to close contact with the inner peripheral surface 2*i* of the golf club shaft 2 as shown in FIG. 2, or slightly smaller than the inner diameter of the golf club shaft 2. Thereby, at the time of hitting the ball, the movement of the weight member assembly 10 in the interior space (i) of the golf club shaft 2 is prevented as much as possible, and the occurrence of undesirable vibration can be suppressed.

Further, the cover 20 in this example includes a first end cover 22 as shown in FIG. 4.

The first end cover 22 covers the first end surface 11 of the weight member 5. In this example, the first end cover 22 covers the entire first end surface 11 of the weight member 5.

Thus, he weight member 5 is prevented from directly contacting with the end portion 4*b* of the grip 4.

This provides a new advantage in that the vibration of the golf club head 3 at the time of hitting the ball is suppressed from being directly transmitted from the weight member 5 to the grip 4, and the hitting feel is prevented from being deteriorated.

The first end cover 22 in this example is provided with a first through hole 25 at a position corresponding to that of the center hole 7 of the weight member 5.

Thus, the weight member assembly 10 is provided with a continuous through hole extending in the axis direction of the golf club shaft from the inside to the outside of the shaft. such through hole can be used as an air vent hole when assembling the golf club 1 as explained above.

Further, the cover 20 may be provided with a second end stopper in the form of an annular inward flange protruding inwardly from the inner peripheral surface of the side cover 21 to contact with the second end surface 12 and thereby to prevent a possible movement of the weight member 5 toward the second end 2*b*.

Further, the cover 20 may be provided with a flange portion 23. The flange portion 23 protrudes outwardly and radially of the golf club shaft from the side cover 21. The flange portion 23 in this example has an outer diameter larger than the outer diameter of the side cover 21. The flange portion 23 in this example is an annular body continuous in the circumferential direction of the golf club shaft. As shown in FIG. 2, the flange portion 23 is sandwiched between the first end 2*a* of the golf club shaft 2 and the end portion 4*b* of the grip 4, and thereby the position of the flange portion 23 is fixed.

In the weight member assembly 10 in this example, as is apparent from the above description, the outer diameter of the side cover 21 is such that the side cover 21 can be disposed in the interior space (i) of the golf club shaft 2 from the first end (2*a*) side, and the outside diameter of the flange portion 23 is such that the flange portion 23 can be engaged with the first end 2*a* of the golf club shaft 2.

As described above, the side cover 21 may be in contact with the inner peripheral surface 2*i* of the golf club shaft 2 or may be separated therefrom as far as the flange portion 23 is secured between the first end 2*a* of the golf club shaft 2 and the inner surface of the end portion 4*b* of the grip 4.

In such weight member assembly 10, as the weight member 5 does not directly contact with either the golf club shaft 2 or the grip 4, the generation of abnormal noise or unpleasant vibration when hitting the ball can be effectively prevented.

Figure 5:
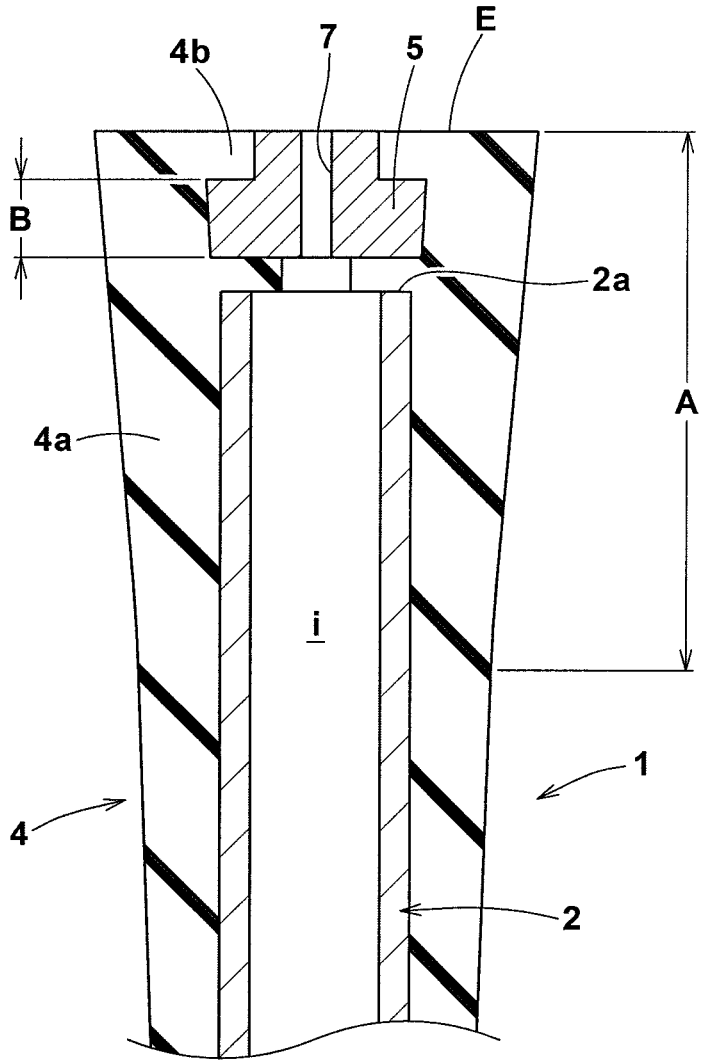
FIG. 5 is a cross-sectional partial view of the grip of a golf club as another embodiment of the present invention.

FIG. 5 shows a cross section of another example of the grip-end portion of the golf club 1.

The weight member 5 in this example is attached to the grip 4 rather than the golf club shaft 2. More specifically, the weight member 5 is embedded in the end portion 4*b* of the grip 4 so as not to directly contact with the golf club shaft 2. In this example, too, the center of gravity of the golf club can be shifted toward the grip 4 while controlling an excessive increase in the mass of the golf club and suppressing the heavy feeling of the swing balance of the golf club.

The weight member 5 in this example is provided with a central through hole 7 extending in the axis direction of the golf club shaft, and the weight member 5 is composed of its cylindrical main portion and a retainer in the form of an outward flange protruding radially from the cylindrical main portion in its second end (2*b*) side.

While detailed description has been made of preferable embodiments of the present invention, the present invention can be embodied in various forms without being limited to the illustrated embodiments.

Comparison Tests

Figure 6:
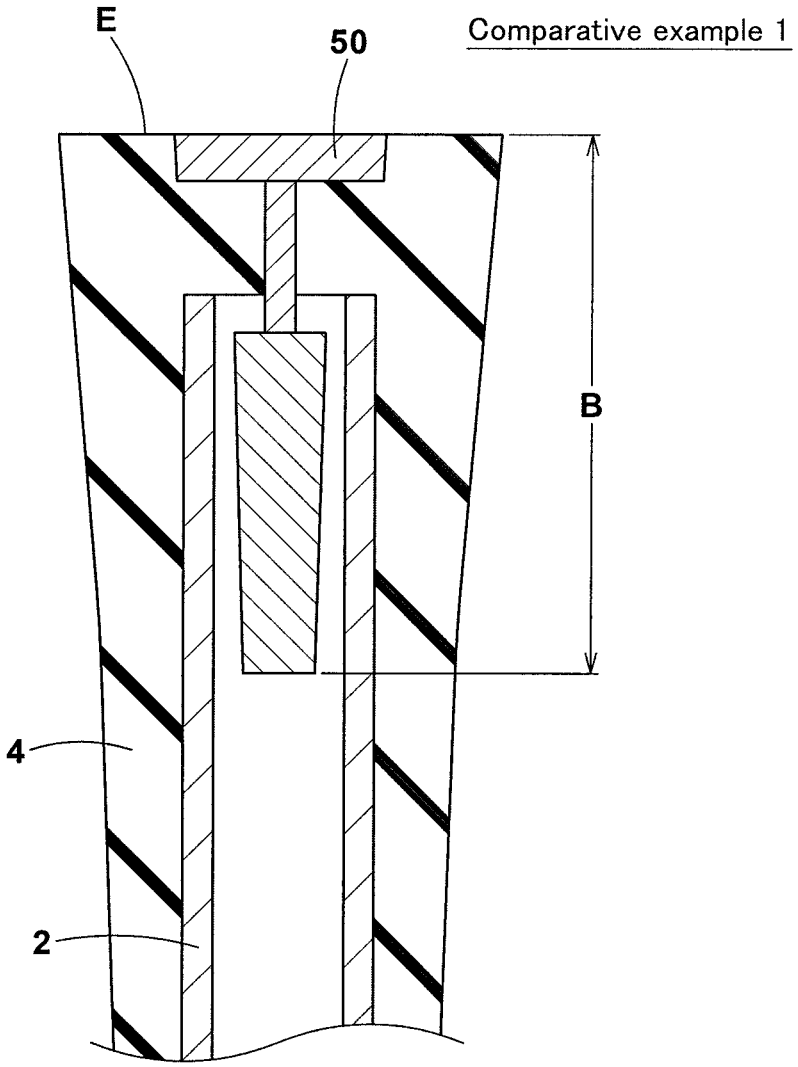
FIG. 6 is a cross-sectional partial view of the grip of a golf club as comparative Example 1.
Figure 7:
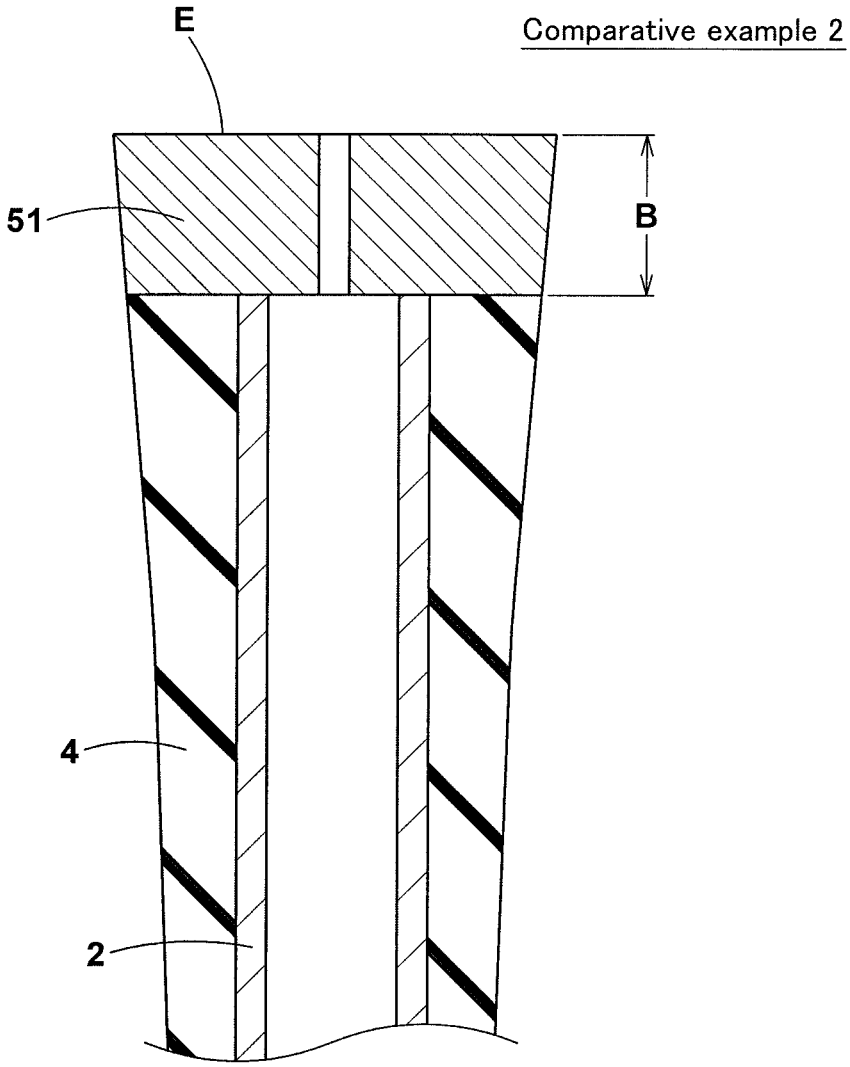
FIG. 7 is a cross-sectional partial view of the grip of a golf club as Comparative Example 2.

In order to confirm the effects of the present invention, golf clubs were experimentally manufactured. The golf clubs under test included: working Example Ex. 1 whose grip-end portion had the structure shown in FIG. 2; comparative Example Ref. 1 whose grip-end portion had the structure shown in FIG. 6; and comparative Example Ref. 2 whose grip-end portion had the structure shown in FIG. 7.

In comparative Example Ref. 1, the length B of the weight member 50 in the axis direction of the golf club shaft was larger than 20 mm.

In comparative Example Ref. 2, the end portion of the grip 4 is formed by a separate metallic weight member 51.

Specifications of these golf clubs are shown in Table 1.

Otherwise all the golf clubs had the same structure.

<Swing Test >

Ten average golfers evaluated each golf club into three grades of good (light), normal and bad (heavy) about whether the swing weight is heavy or light based on their feelings, and their major opinions (good, normal, bad) about the respective golf clubs are shown in Table 1.

<Grip Feeling Test>

Further, the ten average golfers evaluated the grip feeling of each golf club into three grades of good, normal and bad and their major opinions are also shown in Table 1.

Figure 8:
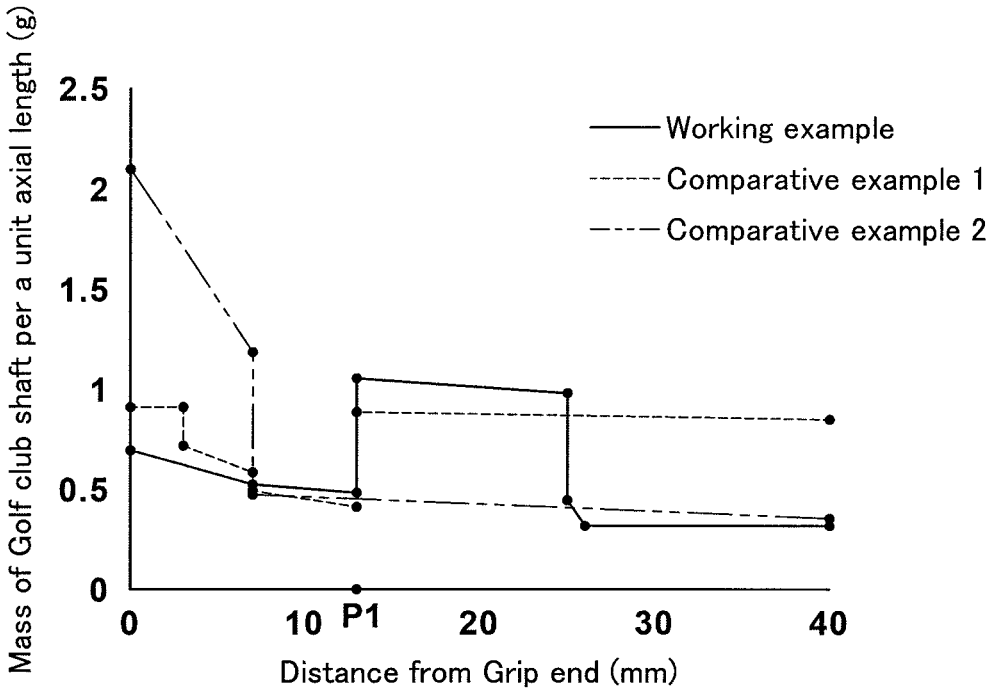
FIG. 8 is a graph showing mass distribution curves of Example and Comparative Example 1-2.

Mass distribution curves of the respective grip-end portions of the golf clubs under test are shown in FIG. 8, wherein the horizontal axis represents a position in the axis direction of the golf club shaft indicated by the distance in mm from the grip end E, and the vertical axis represents the mass in gram of a minute section of the golf club shaft in the axis direction thereof, wherein the dimension of the minute section in the axis direction was 1 mm.

As shown, in the mass distribution curve of comparative Example Ref. 1, the mass of the minute section was rapidly increased at the distance P1, and thereafter maintained a constant value until the end of the grip-end portion, therefore the curve had no local maximum.

In the mass distribution curve of Comparative Example Ref. 2, the mass of the minute section was decreased in the entire range of the grip-end portion, therefore the curve had no local maximum.

As to the mass distribution curve of working Example Ex. 1, please refer to the above description of FIG. 3.

TABLE 1

| Club | Ex. 1 | Ref. 1 | Ref. 2 |
|---|---|---|---|
| mass of golf club (g) | 280 | 310 | 280 |
| mass of weight member (g) | 10 | 40 | 10 |
| swing weight or balance | D1 | D7 | D1 |
| specific gravity of weight member | 8.5 | 11 | 2.5 |
| length B of weight member (mm) | 12 | 40 | 7 |
| maximum value within grip-end portion | present | present | absent |
| difference w1 − w2 (g) | 0.66 | 0.47 | — |
| easiness of swing | good | bad | good |
| grip feeling | good | good | bad |

In the golf club Ex. 1, the weight member was downsized and the mass distribution curve had a local maximum within the grip-end portion (A) as shown in FIG. 8.

Therefore, the center of gravity of the golf club Ex. 1 could be shifted toward the grip while suppressing an excessive increase in the mass of the golf club and the heavy feeling of the swing balance of the golf club.

In the golf club Ref. 1, as the length B of the weight member 50 was large, the mass of the golf club was also large. Further, as the mass distribution curve did not have a maximum value within the grip-end portion, the counterbalance effect was insufficient. As a result, the club became hard to swing.

In the golf club Ref. 2, although the counterbalance effect could be obtained, as the end portion of the grip 4 was formed by the metallic weight member 51, the grip had a problem with its formability. In addition, the grip was felt as hard when gripped, and the feeling at the time of holding the golf club was poor.

DESCRIPTION OF THE REFERENCE SIGNS

1 golf club
2 golf club shaft
2*a* first end
2*b* second end
3 golf club head
4 grip
5 weight member
20 cover
E grip end
f mass distribution curve
i interior space

The invention claimed is:

1. A golf club comprising:

a golf club shaft extending from its first end to its second end in an axial direction thereof;

a grip attached to the first end of the golf club shaft and having a grip end which defines an end of the golf club on a first end side;

a golf club head attached to the second end of the golf club shaft; and a weight attached to the golf club shaft, wherein a specific gravity of the weight is 2.5 or more, a length of the weight measured in the axial direction is 20 mm or less, and the weight is disposed in a grip-end portion of the golf club so that a mass distribution in the axial direction of the grip-end portion has a local maximum occurring at a position within the grip-end portion, wherein the grip-end portion is defined as extending from the grip end toward the second end by a length of 40 mm in the axial direction, and the local maximum occurs at a minute section of the golf club in the axial direction of the golf club shaft which includes a portion of the grip, a portion of the golf club shaft, a portion of a cover that covers the weight, and a portion of the weight, wherein the golf club shaft is a pipe having an interior space therein, and the weight is disposed in the interior space in its first end side, wherein the weight is covered with the cover that is an elastic cover so as not to directly contact with the golf club shaft, wherein the grip comprises a grip portion surrounding a first end portion of the golf club shaft to be gripped by a golfer, and an end portion positioned at one end of the grip portion on the first end side to define said grip end, wherein the elastic cover includes a flange portion protruding outwardly and radially of the golf club shaft from a side cover to have an outer diameter larger than an outer diameter of the side cover, and the flange portion is secured between the first end of the golf club shaft and said end portion of the grip.

2. The golf club according to claim 1, wherein the mass distribution has said local maximum as only one local maximum.

3. The golf club according to claim 1, wherein the mass distribution has a minimum occurring at a position within the grip-end portion, and a difference between a mass of a first minute section of the golf club at the position where the local maximum occurs and a mass of a second minute section of the golf club at the position where the minimum occurs is 0.5 g or more when a dimension of each of the first minute section and the second minute section in the axial direction is 1 mm.

4. The golf club according to claim 3, wherein in the mass distribution from 0 to 40 mm from the grip end, a mass of a minute section of the golf club gradually decreases from a first point at the grip end to a second point, then increases from the second point to a third point, and gradually decreases from the third point to a fourth point and then sharply decreases from the fourth point, then again gradually decreases to a fifth point at a distance of 40 mm from the grip end, whereby said local maximum occurs at the third point.

5. The golf club according to claim 4, wherein a distance of the third point at which said local maximum occurs is not more than 20 mm from the grip end.

6. The golf club according to claim 1, wherein the weight is arranged without protruding from the golf club shaft.

7. The golf club according to claim 1, wherein the weight has a first end surface and a second end face in the axial direction, and a cylindrical outer peripheral surface, and the elastic cover includes the side cover covering the cylindrical outer peripheral surface, and a first end cover covering the first end surface of the weight.

8. The golf club according to claim 1, wherein the cover is made of a vulcanized rubber.

9. The golf club according to claim 1, wherein the cover is made of a resinous material.

10. The golf club according to claim 1, wherein the weight is made of brass.

11. The golf club according to claim 1, wherein a distance at which said local maximum occurs is not more than 20 mm from the grip end.

12. The golf club according to claim 1, wherein the mass distribution is defined by a mass of each minute section of the golf club in the axial direction and each minute section has a dimension of 1 mm in the axial direction.

13. The golf club according to claim 1, wherein the mass distribution is defined by a mass of the grip-end portion per each 1 mm unit of length portion of the grip-end portion in the axial direction, and has the local maximum occurring at a position within one 1 mm unit of length portion of the grip-end portion.

14. A golf club comprising:

a golf club shaft extending from its first end to its second end in an axial direction thereof;

a grip attached to the first end of the golf club shaft and having a grip end which defines an end of the golf club on a first end side;

a golf club head attached to the second end of the golf club shaft; and a weight attached to the golf club shaft, wherein a specific gravity of the weight is 2.5 or more, a length of the weight measured in the axial direction is 20 mm or less, the weight is disposed in a grip-end portion of the golf club so that a mass distribution in the axial direction of the grip-end portion has a local maximum occurring at a position within the grip-end portion, wherein the grip-end portion is defined as extending from the grip end toward the second end by a length of 40 mm in the axial direction, the golf club shaft is a pipe having an interior space therein, the weight is disposed in the interior space in its first end side, the weight is covered with an elastic cover so as not to directly contact with the golf club shaft, the weight has a first end surface and a second end face in the axial direction, and a cylindrical outer peripheral surface, the elastic cover includes a side cover covering the cylindrical outer peripheral surface, and a first end cover covering the first end surface of the weight, the weight is formed in a cylindrical shape having a center hole extending in the axial direction of the golf club shaft, and the first end cover is provided with a first through hole at a position corresponding to that of the center hole of the weight.

* * * * *